US011560205B2

(12) United States Patent
Maher et al.

(10) Patent No.: US 11,560,205 B2
(45) Date of Patent: Jan. 24, 2023

(54) LIFTING SYSTEM FOR A FLOATING VESSEL

(71) Applicant: Trendsetter Vulcan Offshore, Inc., Houston, TX (US)

(72) Inventors: James V. Maher, Houston, TX (US); Ricky Brown, Houston, TX (US); David Sverre, Gibbons (CA)

(73) Assignee: Trendsetter Vulcan Offshore, Inc.

( * ) Notice: Subject to any disclaimer, the term of this patent is extended or adjusted under 35 U.S.C. 154(b) by 0 days.

(21) Appl. No.: 17/449,289

(22) Filed: Sep. 29, 2021

(65) Prior Publication Data

US 2022/0097805 A1 Mar. 31, 2022

Related U.S. Application Data

(60) Provisional application No. 63/085,592, filed on Sep. 30, 2020.

(51) Int. Cl.
*B63B 27/12* (2006.01)
*B66C 19/00* (2006.01)

(52) U.S. Cl.
CPC ..... *B63B 27/12* (2013.01); *B66C 19/00* (2013.01)

(58) Field of Classification Search
CPC ..... B63B 27/12; B66C 19/00; B66C 17/00; B66C 2700/0328; B66C 5/06; B66C 5/10; B66C 19/02; B66C 7/12; B66C 23/52; B66C 23/525; B66C 23/53; B65G 1/04; B65G 1/0407; B65G 1/0492
See application file for complete search history.

(56) References Cited

U.S. PATENT DOCUMENTS 3,498,477 A * 3/1970 Sommer ..... B63B 27/12 114/201 R
3,645,405 A * 2/1972 Stiglich ..... B66C 23/52 212/294
3,783,792 A * 1/1974 Cullom ..... B66C 17/00 212/316
7,381,022 B1 * 6/2008 King ..... B65G 1/1375 414/807

* cited by examiner

*Primary Examiner* — Gregory W Adams
(74) *Attorney, Agent, or Firm* — Jonathan Pierce; Pierre Campanac; Porter Hedges LLP

(57) ABSTRACT

A lifting system includes elevator towers constructed on a deck of a floating vessel, tracks constructed above the deck of the floating vessel, a traveling cradle beam, and one or more cranes supported by the traveling cradle beam. The traveling cradle beam can be in a first configuration in which the traveling cradle beam is coupled to the elevator towers and can move along the elevator towers past the tracks, and in a second configuration in which the traveling cradle beam is decoupled from the elevator towers and can skid over the tracks. The lifting system can be constructed in stages, and the portion of the lifting system constructed in the initial stages can be used to continue constructing the lifting system in the remaining stages. The lifting system can be used for transporting equipment on the floating vessel.

10 Claims, 7 Drawing Sheets

LIFTING SYSTEM FOR A FLOATING VESSEL

CROSS-REFERENCE TO RELATED APPLICATIONS

This application claims the benefit of priority to US provisional application Ser. No. 63/085,592 filed on Sep. 30, 2020, which is incorporated herein by reference for all and any purposes.

BACKGROUND

This disclosure relates generally to lifting systems for a floating vessel. This disclosure relates more specifically to lifting systems for a floating production storage and offloading (FPSO) vessel that can be used for repairing or upgrading the production equipment of the FPSO vessel.

An FPSO vessel is used in the offshore oil and gas industry for the processing and storage of fluids produced from nearby platforms or subsea production systems. The fluids are processed and stored on the FPSO vessel until an amount of hydrocarbons that is sufficient to fill a tanker is available. For processing the hydrocarbons, the FPSO vessel can include equipment for separating gas, water, and oil, for treating produced water, for treating and injecting seawater, for compressing and cooling produced gas, etc. This equipment is typically located on the deck of the FPSO vessel.

To accommodate the equipment used for processing the hydrocarbons, the deck of the FPSO vessel may be long and wide. When the production equipment of the FPSO vessel needs repairing or upgrading, it may be difficult to access the equipment with cranes or other lifting systems.

Thus, there is a continuing need in the art for methods and apparatus for lifting systems for a floating vessel.

SUMMARY

In some aspects, the disclosure describes a method of constructing a lifting system for a floating vessel. The method may comprise the steps of constructing elevator towers on a deck of the floating vessel, coupling a traveling cradle beam to the elevator towers, attaching track elements to one or more cranes supported by the traveling cradle beam, lifting the track elements using the traveling cradle beam and the elevator towers, and constructing a first portion of tracks above the deck of the floating vessel with the track elements. Preferably, but not necessarily, the first portion of the tracks comprises movable arms, and the traveling cradle beam can be decoupled from the elevator towers to move over the first portion of the tracks. Optionally, the method may comprise the step of constructing a second portion of the tracks above the deck of the floating vessel with the track elements, the second portion of the tracks being adjacent to the first portion of the tracks.

In other aspects, the disclosure describes a lifting system for a floating vessel. The lifting system may comprise elevator towers constructed on a deck of the floating vessel, a traveling cradle beam selectively couplable to and decouplable from the elevator towers, tracks constructed above the deck of the floating vessel, and a means for moving the traveling cradle beam over at least a portion of the tracks. Preferably, but not necessarily, the tracks include movable arms. Optionally, the lifting system comprises one or more cranes and/or a monorail trolley that are supported by the traveling cradle beam.

In yet other aspects, the disclosure describes a method of transporting equipment on a floating vessel. The method may comprise the step of providing a lifting system on the floating vessel. The lifting system may include elevator towers located on a deck of the floating vessel, a traveling cradle beam selectively couplable to and decouplable from the elevator towers, tracks located above the deck of the floating vessel, and a means for moving the traveling cradle beam over at least a portion of the tracks. The method may further comprise the steps of attaching equipment to be installed on the floating vessel to the traveling cradle beam, lifting the equipment past the tracks using the traveling cradle beam coupled to the elevator towers, decoupling the traveling cradle beam from the elevator towers, moving the traveling cradle beam over the first portion of the tracks, transporting the equipment to be installed on the floating vessel above the deck of the floating vessel, lowering the equipment to be installed on the floating vessel on the deck of the floating vessel, and detaching the equipment to be installed on the floating vessel from the traveling cradle beam.

BRIEF DESCRIPTION OF THE DRAWINGS

For a more detailed description of the embodiments of the disclosure, reference will now be made to the accompanying drawings, wherein.

DETAILED DESCRIPTION

Figure 1:
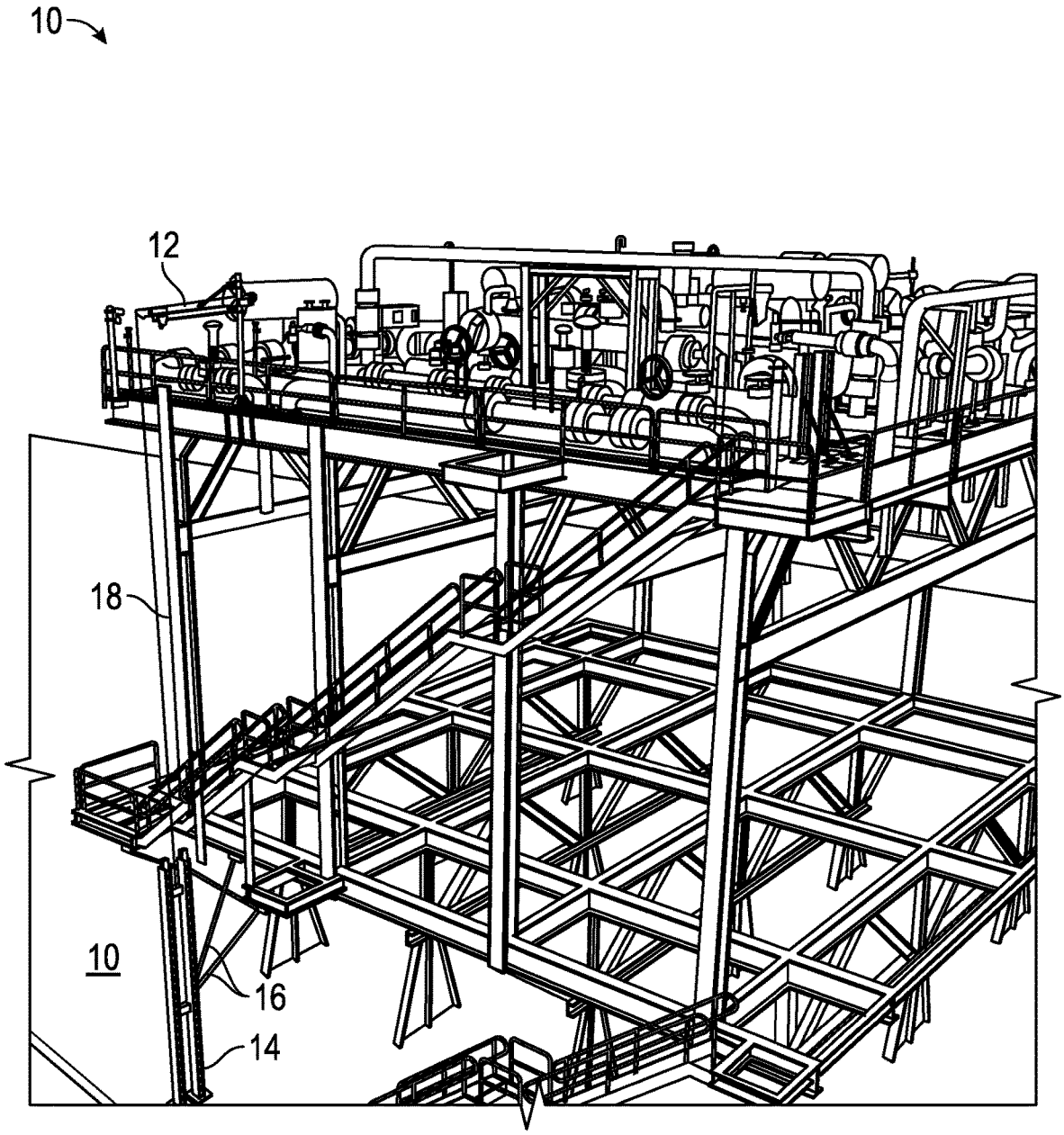
FIG. 1 illustrates the construction of an elevator tower on the deck of an FPSO vessel.

It is to be understood that the following disclosure describes several exemplary embodiments for implementing different features, structures, or functions of the invention. Exemplary embodiments of components, arrangements, and configurations are described below to simplify the disclosure; however, these exemplary embodiments are provided merely as examples and are not intended to limit the scope of the invention. Additionally, the disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Finally, the exemplary embodiments presented below may be combined in any combination of ways, i.e., any element from one exemplary embodiment may be used in any other exemplary embodiment, without departing from the scope of the disclosure.

The disclosure describes a lifting system for a floating vessel, for example, an FPSO vessel. The lifting system comprises elevator towers constructed on a deck of the floating vessel and tracks constructed above the deck of the floating vessel. The lifting system also comprises a traveling cradle beam and one or more cranes supported by the traveling cradle beam. The one or more cranes may be davits, jib cranes, gantry cranes, or other known types of cranes. The traveling cradle beam is selectively couplable to, and decouplable from, the elevator towers and can move over the tracks. A person having ordinary skill in the art would know how to implement a cradle beam that is selectively couplable to, and decouplable from, the elevator towers. A means for moving the traveling cradle beam over the tracks is provided between the tracks and the traveling cradle beam along at least a portion of the tracks. Such a means may include a skidding system, such as available from Hydra-Slide, a roller bearing system, or another known system capable of reducing the friction between the traveling cradle beam and the tracks.

In order to transition the traveling cradle beam between a first configuration in which the traveling cradle beam is coupled to the elevator towers and can move along the elevator towers past the tracks, and a second configuration in which the traveling cradle beam is decoupled from the elevator towers and can skid over the tracks, the tracks include movable arms. The movable arms have an extended position where the movable arms can support the traveling cradle beam after the traveling cradle beam is decoupled from the elevator towers, and a retracted position where the movable arms allow the traveling cradle beam to move along the elevator towers past the tracks.

The lifting system can be used for transporting equipment on a floating vessel.

The lifting system can be constructed in stages, and the portion of the lifting system constructed in the initial stages can be used to continue constructing the lifting system in the remaining stages.

Referring to FIG. 1, the first stage of the construction of the lifting system on an FPSO vessel is illustrated. During the first stage, an elevator tower 14 is constructed on the ship side of the main deck 10 of the FPSO vessel. A davit 12 that is mounted on the upper deck structure 18 of the FPSO vessel may be used to lift parts to form the elevator tower 14. The davit 12 may also be used to lift braces and beam clamps 16 used for securing the elevator tower 14 to the upper deck structure 18. The first stage of the construction of the lifting system may continue until two elevator towers 14 are constructed on the main deck 10 of the FPSO vessel and are secured to the upper deck structure 18, as is shown in FIG. 2.

Figure 2:
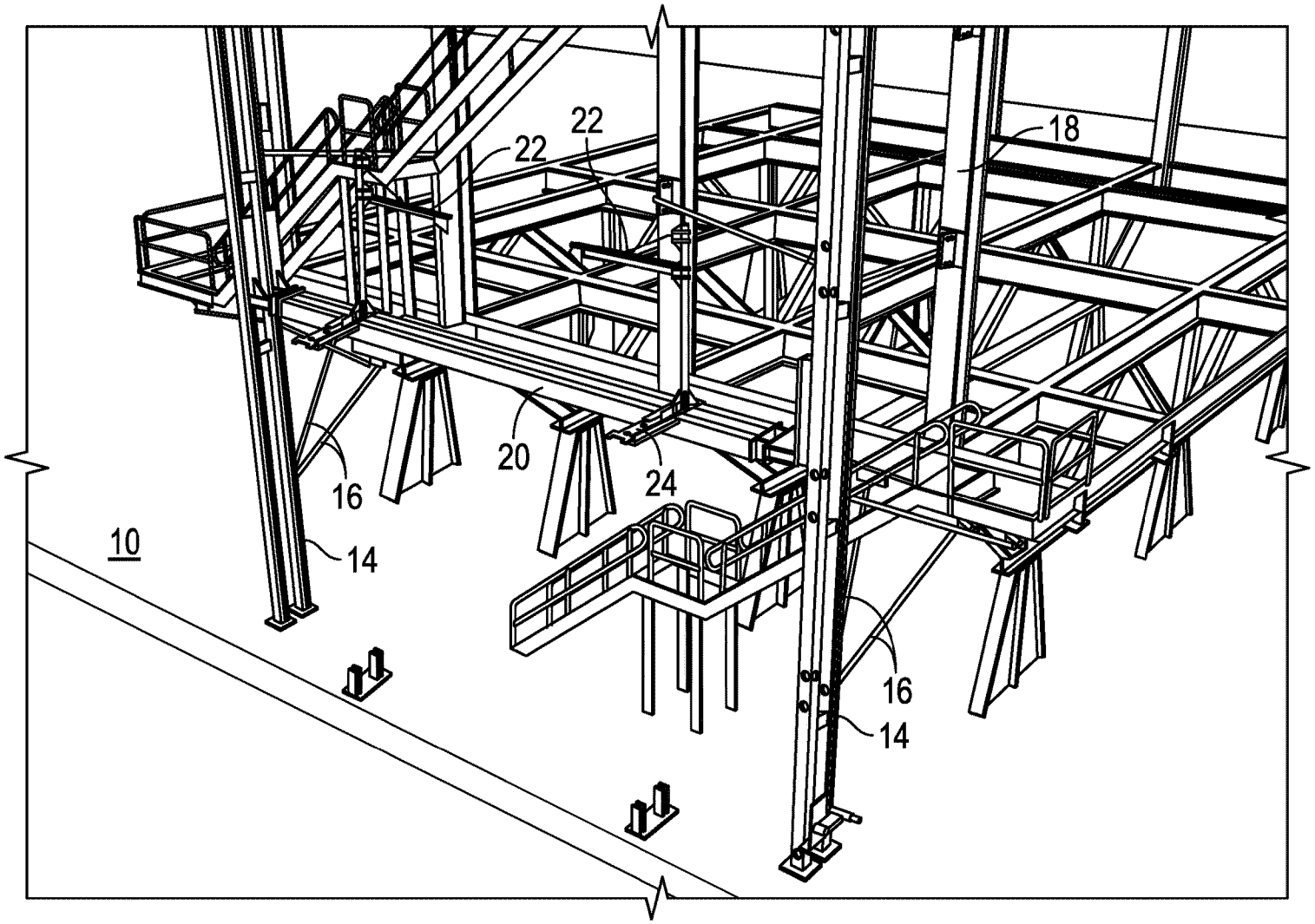
FIG. 2 illustrates a traveling cradle beam coupled to elevator towers, the traveling cradle beam supporting one or more davits.

Referring to FIG. 2, the second stage of the construction of the lifting system on the FPSO vessel is illustrated. A traveling cradle beam 20 is coupled to the elevator towers 14. The traveling cradle beam 20 may be straight between the elevator towers 14 or may optionally include cross-beams 24. The traveling cradle beam 20 can move along the elevator towers 14. The traveling cradle beam 20 supports one or more davits 22 (or other types of cranes). A means for moving the one or more davits 22 over the traveling cradle beam 20 may optionally be provided between the traveling cradle beam 20 and the one or more davits 22 along at least a portion of the traveling cradle beam 20, such as, for example as shown in FIG. 2, along the cross-beams 24. Such a means may include a skidding system, such as available from Hydra-Slide, a roller bearing system, or another known system capable of reducing the friction between the one or more davits 22 and the traveling cradle beam 20.

After the second stage of its construction, the lifting system can be used to lift parts above the upper decks 18 to continue the construction of the lifting system during the remaining stages of construction. One possible advantage of using the lifting system after the second stage of construction may be that the lifting system can have a lifting power greater than the lifting power of the davit 12 that is mounted on the upper deck structure 18. Thus, the lifting system may lift weights faster than the davit 12 and/or heavier weights than the davit 12.

Figure 3:
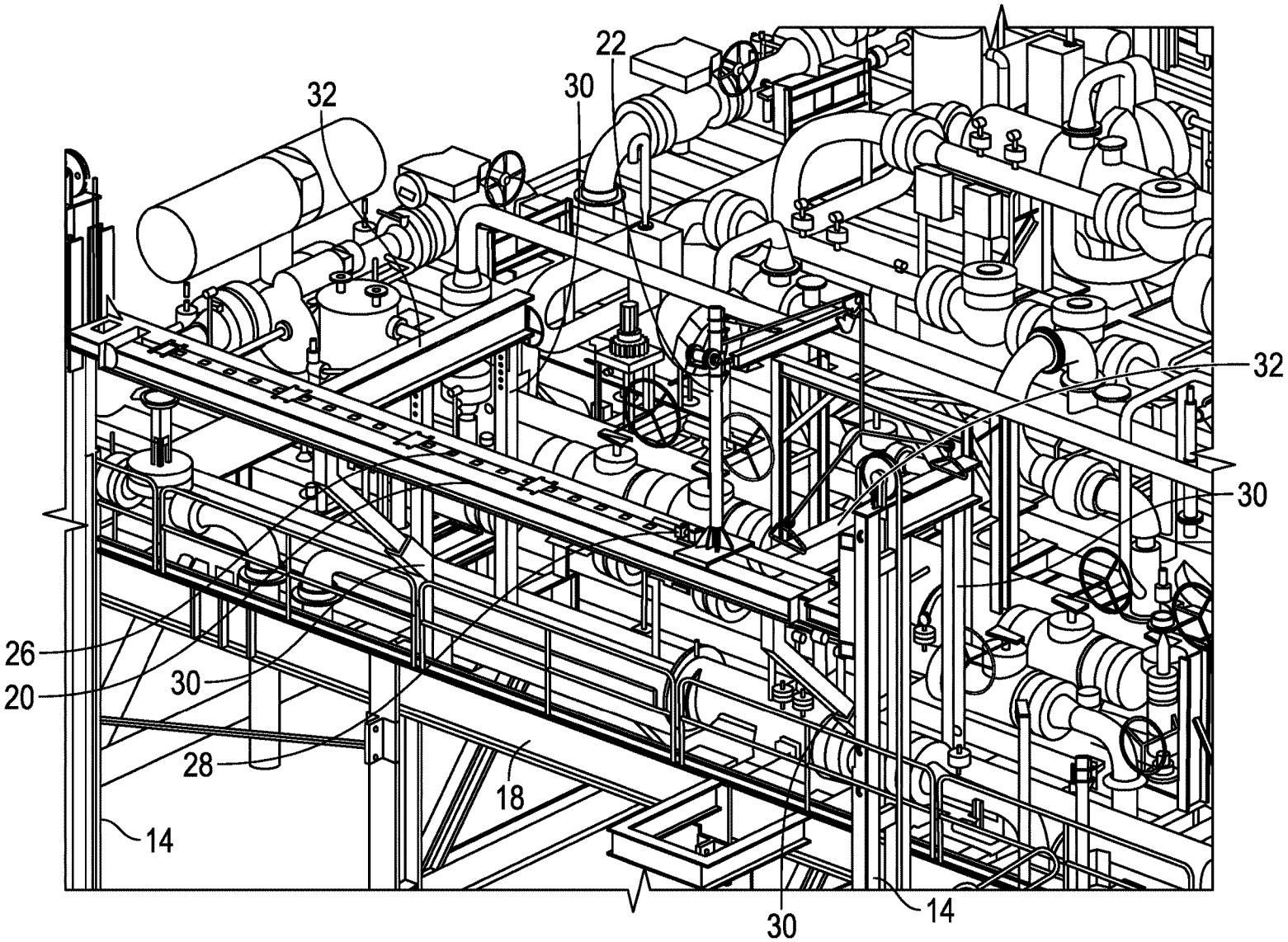
FIG. 3 illustrates the initial construction of a track including swing-out arms using the one or more davits supported by the traveling cradle beam and the elevator towers previously constructed.

Referring to FIG. 3, the third stage of the construction of the lifting system on the FPSO vessel is illustrated. The traveling cradle beam 20 and the elevator towers 14 previously constructed are used to lift the parts of a platform on the upper deck structure 18. Using the one or more davits 22, the platform is assembled above the main deck 10 next to the traveling cradle beam 20 and the elevator towers 14. The platform includes vertical columns 30 and horizontal track portions 32 coupled to the vertical columns 30. In the example shown in FIG. 3, the columns 30 of the platform are mounted on the upper deck structure 18, but in other examples, the columns 30 may be mounted directly on the main deck 10. In the example shown in FIG. 3, a skidding system includes skid shoes 26 (e.g., including a low-friction mat made of graphite) and hydraulic actuator(s) 28 that is(are) coupled to the traveling cradle beam 20 and the one or more davits 22 for pushing or pull the one or more davits 22 on the skid shoes 26.

A means for moving the traveling cradle beam 20 over the track portions 32 is provided between the track portions 32 and the traveling cradle beam 20 along at least a portion of the track portions 32. Such a means may include a skidding system, such as available from Hydra-Slide, a roller bearing system, or another known system capable of reducing the friction between the traveling cradle beam and the tracks.

Figure 4:
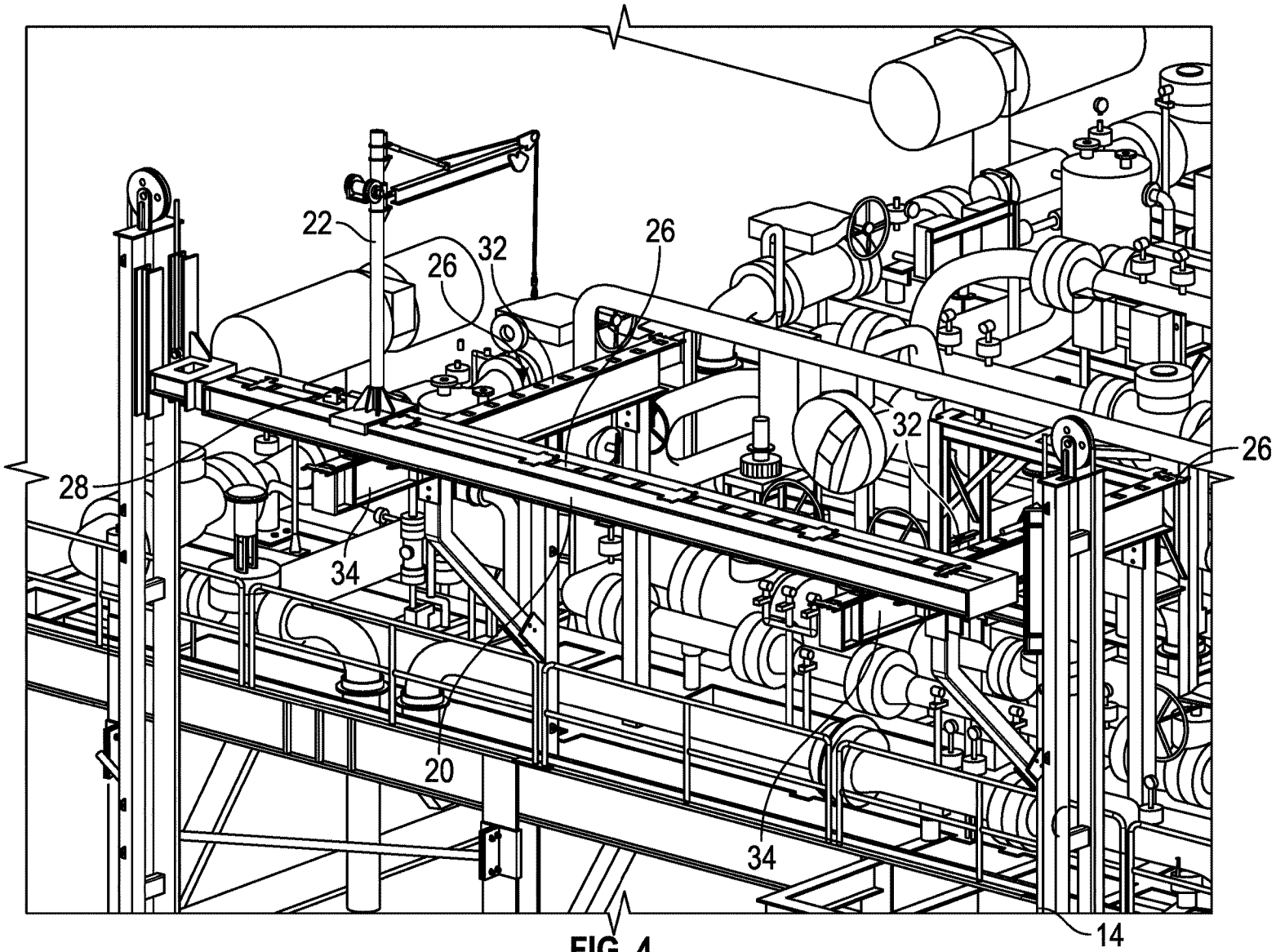
FIG. 4 illustrates the extension of the swing-out arms for supporting the traveling cradle beam on the track initially constructed.

Referring to FIG. 4, the track portions 32 include movable arms, such as swing-out arms 34. In the example shown, the swing-out arms 34 pivot in the horizontal plane between an extended position (illustrated in FIGS. 4 and 5) and a retracted position (illustrated in FIGS. 6 and 7). In other examples, the swing-out arms 34 may pivot in the vertical plane between an extended position (similar to FIGS. 4 and 5) and a retracted position (not shown). In yet other examples, the movable arms may be implemented with a dovetail or a linear bearing allowing the arms to slide relative to a remainder of the track portions 32.

The swing-out arms 34 are initially retracted for allowing the traveling cradle beam 20 to move along the elevator towers 14 past the track portions 32. After the traveling cradle beam 20 is hoisted above the track portions 32, the swing-out arms 34 are extended. In this position, the swing-out arms 34 are capable of supporting the traveling cradle beam 20. The traveling cradle beam 20 can then be disconnected from the elevator towers 14.

Figure 5:
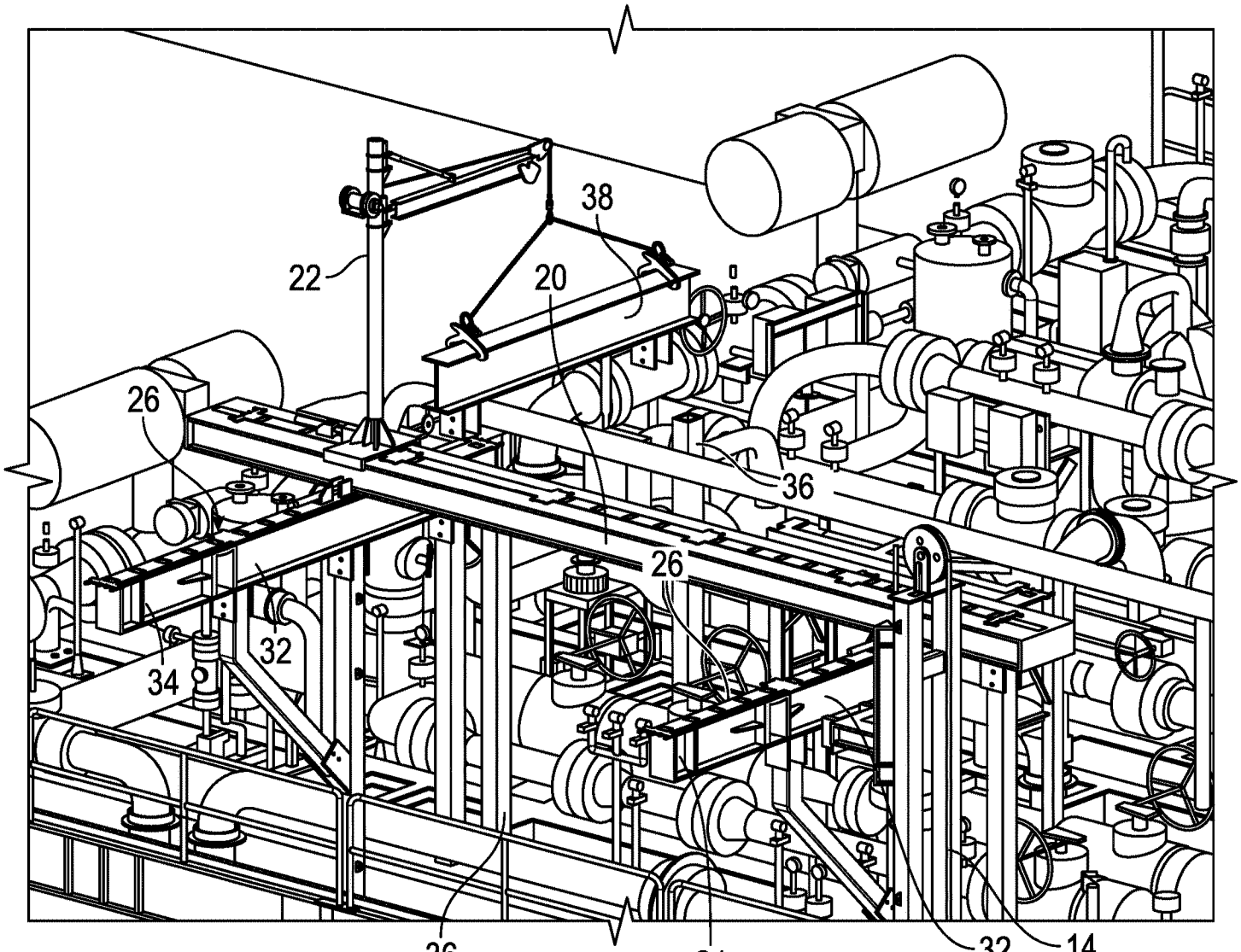
FIG. 5 illustrates the continued construction of the track using the traveling cradle and the track initially constructed.

Referring to FIG. 5, the fourth stage of the construction of the lifting system on the FPSO vessel is illustrated. The traveling cradle beam 20 and the elevator towers 14 are used to lift additional parts for extending the platform inward on the upper deck structure 18. Similarly to FIG. 3, the platform extension includes vertical columns 36 and horizontal track portions 38 coupled to the vertical columns 36.

In addition to the third stage illustrated in FIG. 3, after the traveling cradle beam 20 is disconnected from the elevator towers 14, the traveling cradle beam 20 can move on the track portions 32 initially constructed. Thus, the platform can be extended inward on the upper deck structure 18, adjacent to the portion of the platform initially constructed, despite the limited span of the one or more davits 22.

Additional stages similar to the fourth of the construction of the lifting system on the FPSO vessel may be added until the platform reaches a desired location on the main deck 10 of the FPSO vessel.

Figure 6:
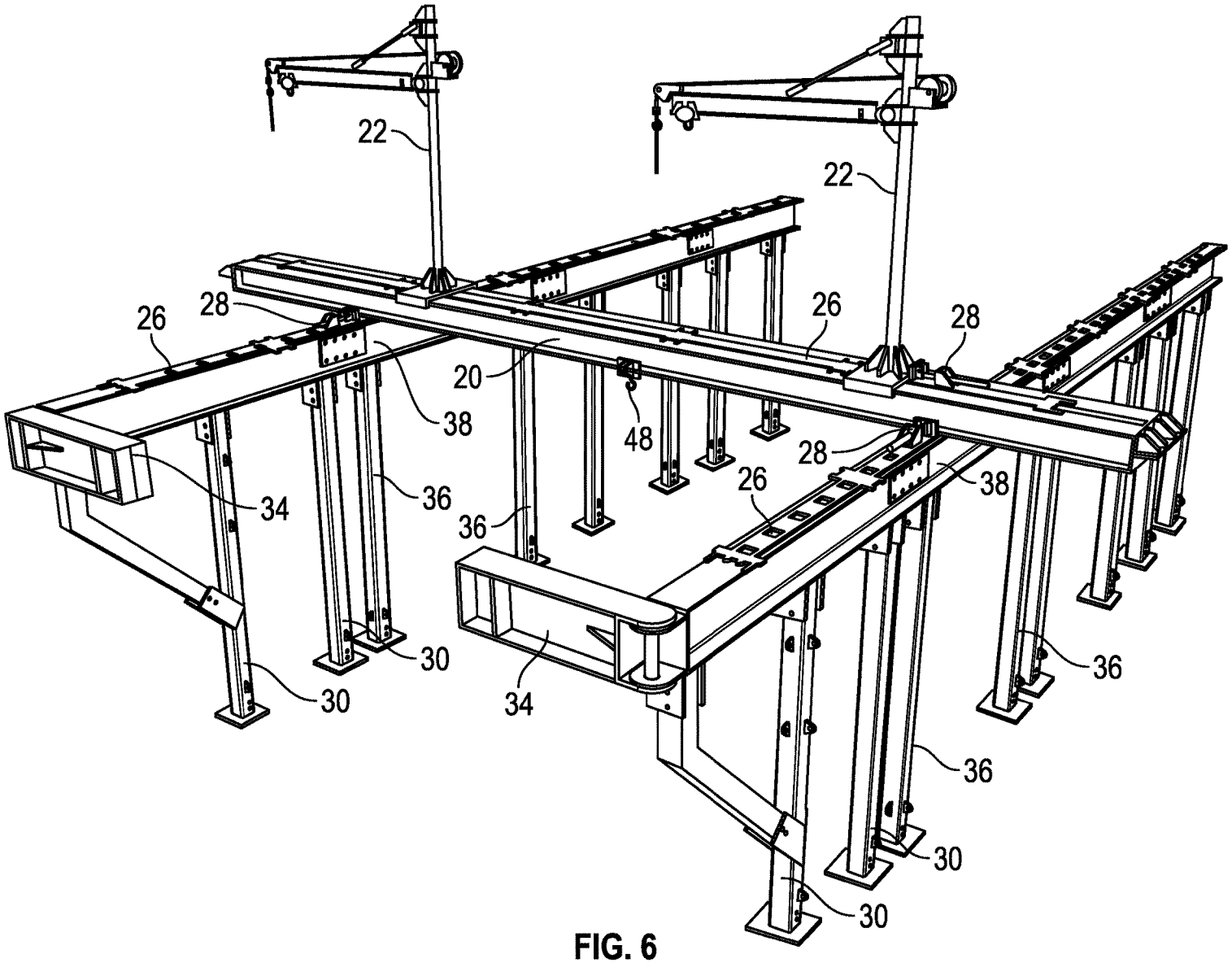
FIG. 6 illustrates the completed construction of the track.

FIG. 6 illustrates the completed construction of the track. In addition to the features previously described, the traveling cradle beam 20 supports a monorail trolley 48 that forms a part of a gantry crane. Optional handrails and platforms can be provided around the tracks for operators.

Figure 7:
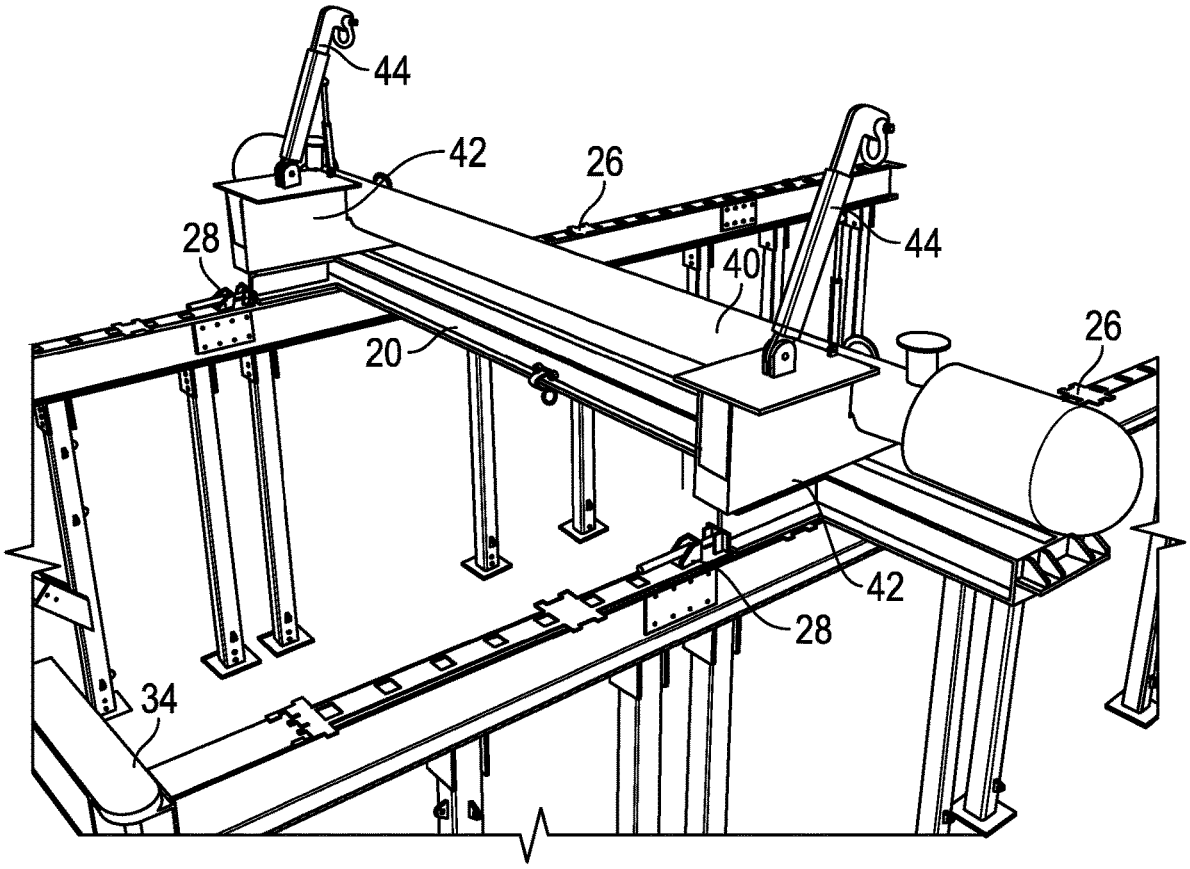
FIG. 7 illustrates the transportation of equipment using the track.

FIG. 7 illustrates the transportation of equipment 40 (e.g., a gas cooler) using the track. The traveling cradle beam 20 is equipped with bumpers 42 and two jib cranes 44 (or other A-frame crane) suitable to lift the equipment 40 from a vessel and deliver the equipment 40 on the bumpers 42 in a position where the equipment 40 can be lifted by the traveling cradle beam 20 and the elevator towers 14 as the swing-out arms 34 are retracted.

The swing-out arms 34 are extended after the traveling cradle beam 20 has moved past the track. The traveling cradle beam 20 and the equipment 40 are lowered on the swing-out arms 34 that then support the weight of the traveling cradle beam 20 and the equipment 40. The traveling cradle beam 20 is disconnected from the elevator towers 14.

The traveling cradle beam 20 and the equipment 40 are moved horizontally on the tracks using a skidding system including skid shoes 26 and hydraulic actuator(s) 28. The equipment 40 is placed above a desired location where it is to be connected with other equipment on the deck. The desired location may be provided with anchoring points on the track.

The equipment 40 is then lowered using the two jib cranes 44 and/or the monorail trolley 48 and chain falls, tugger winches, etc.

In other embodiments, the davits 22 may be used instead of (or in addition to) the two jib cranes 44.

The claimed invention is susceptible to various modifications and alternative forms, specific embodiments thereof are shown by way of example in the drawings and description. It should be understood, however, that the drawings and detailed description thereto are not intended to limit the claims to the particular form disclosed, but on the contrary, the intention is to cover all modifications, equivalents, and alternatives falling within the scope of the claims.

What is claimed is:

1. A method of constructing a lifting system for a floating vessel, comprising:

constructing elevator towers on a deck of the floating vessel;

coupling a traveling cradle beam to the elevator towers;

attaching track elements to one or more cranes supported by the traveling cradle beam;

lifting the track elements using the traveling cradle beam and the elevator towers;

constructing a first portion of tracks above the deck of the floating vessel with the track elements, wherein the first portion comprises movable arms;

lifting other track elements using the traveling cradle beam and the elevator towers;

extending of the movable arms for supporting the traveling cradle beam on the movable arms;

decoupling the traveling cradle beam from the elevator towers;

moving the traveling cradle beam over the first portion of the tracks;

constructing a second portion of the tracks above the deck of the floating vessel with the other track elements, the second portion of the tracks being adjacent to the first portion of the tracks;

retracting the movable arms for allowing the traveling cradle beam to move along the elevator towers past the tracks; and supporting a monorail trolley that forms a part of a gantry crane with the traveling cradle beam.

2. The method of claim 1, further comprising securing the elevator towers to the deck.

3. The method of claim 1, wherein the first portion of the tracks includes two tracks side by side.

4. The method of claim 1, wherein the second portion of the tracks includes two tracks side by side.

5. A lifting system for a floating vessel, comprising:

elevator towers constructed on a deck of the floating vessel;

a traveling cradle beam selectively couplable to and decouplable from the elevator towers, wherein the traveling cradle beam supports a monorail trolley that forms a part of a gantry crane;

one or more cranes supported by the traveling cradle beam;

tracks constructed above the deck of the floating vessel, wherein the tracks include movable arms;

the movable arms having an extended position where the movable arms can support the traveling cradle beam after the traveling cradle beam is decoupled from the elevator towers, the movable arms having a retracted position where the movable arms allow the traveling cradle beam to move along the elevator towers past the tracks; and a means for moving the traveling cradle beam over at least a portion of the tracks.

6. The lifting system of claim 5, wherein the elevator towers are secured to the deck.

7. The lifting system of claim 5, wherein the tracks include two tracks side by side.

8. A method of transporting equipment on a floating vessel, comprising:

providing a lifting system on the floating vessel, the lifting system including:

elevator towers located on a deck of the floating vessel;

a traveling cradle beam selectively couplable to and decouplable from the elevator towers, wherein the traveling cradle beam supports a monorail trolley that forms a part of a gantry crane;

one or more cranes supported by the traveling cradle beam;

tracks located above the deck of the floating vessel, wherein the tracks include movable arms, the movable arms having an extended position where the movable arms can support the traveling cradle beam after the traveling cradle beam is decoupled from the elevator towers, the movable arms having a retracted position where the movable arms allow the traveling cradle beam to move along the elevator towers past the tracks, and a means for moving the traveling cradle beam over at least a portion of the tracks;

attaching equipment to be installed on the floating vessel to the one or more cranes;

lifting the equipment past the tracks using the traveling cradle beam coupled to the elevator towers;

decoupling the traveling cradle beam from the elevator towers;

extending the movable arms for supporting the traveling cradle beam on the movable arms;

moving the traveling cradle beam over the first portion of the tracks;

transporting the equipment to be installed on the floating vessel above the deck of the floating vessel;

detaching the equipment to be installed on the floating vessel from the one or more cranes;

lowering the equipment to be installed on the floating vessel on the deck of the floating vessel, wherein lowering the equipment to be installed on the floating vessel on the deck of the floating vessel is performed using the monorail trolley; and retracting of the movable arms for allowing the traveling cradle beam to move down the elevator towers past the tracks.

9. The method of claim 8, further comprising securing the elevator towers to the deck.

10. The method of claim 8, wherein the tracks include two tracks side by side.

* * * * *